United States Patent [19]

Ohe et al.

[11] Patent Number: 4,811,024

[45] Date of Patent: Mar. 7, 1989

[54] AUTOMOBILE ANTENNA

[75] Inventors: Junzo Ohe; Hiroshi Kondo, both of Aichi, Japan

[73] Assignee: Toyota Jidosha Kabushiki Kaisha, Toyota, Japan

[21] Appl. No.: 788,219

[22] Filed: Oct. 16, 1985

[30] Foreign Application Priority Data

Oct. 17, 1984 [JP] Japan ..... 59-219170

[51] Int. Cl.[4] ..... H01Q 1/32

[52] U.S. Cl. ..... 343/712; 343/713

[58] Field of Search ..... 343/711, 712, 713

[56] References Cited

U.S. PATENT DOCUMENTS

| | | | |
|---|---|---|---|
| 2,200,674 | 5/1940 | McDonald, Jr. | 343/700 |
| 2,481,978 | 9/1949 | Clough | 343/712 |
| 2,520,986 | 9/1950 | Williams et al. | 343/712 |
| 2,575,471 | 11/1951 | Schweiss et al. | 250/33 |
| 2,740,113 | 3/1956 | Hemphill | 343/787 |
| 2,774,811 | 12/1956 | Shanok et al. | 174/110 |
| 2,859,441 | 11/1958 | Rosenbaum | 343/712 |
| 2,950,479 | 8/1960 | Pan | 343/702 |
| 2,971,191 | 2/1961 | Davis | 343/712 |
| 3,066,293 | 11/1962 | Davis | 343/767 |
| 3,210,766 | 10/1965 | Parker | 343/743 |
| 3,364,487 | 1/1968 | Maheux | 343/702 |
| 3,611,388 | 10/1971 | Okumura | 343/712 |
| 3,717,876 | 2/1973 | Volkers et al. | 343/712 |
| 3,728,732 | 4/1973 | Igarashi | 343/712 |
| 3,794,997 | 2/1974 | Iwatsuki et al. | 343/712 |
| 3,823,403 | 7/1974 | Walter et al. | 343/708 |
| 3,916,413 | 10/1975 | Davis | 343/712 |
| 3,961,292 | 6/1976 | Davis | 333/32 |
| 3,961,330 | 6/1976 | Davis | 343/712 |
| 3,972,048 | 7/1976 | Davis | 343/712 |
| 4,003,056 | 6/1977 | Davis | 343/713 |
| 4,080,603 | 3/1978 | Moody | 343/712 |
| 4,217,591 | 8/1980 | Czerwinski | 343/713 |
| 4,278,980 | 7/1981 | Ogita et al. | 343/748 |
| 4,317,121 | 2/1982 | Allen, Jr. et al. | 343/712 |
| 4,339,827 | 7/1982 | Torres et al. | 343/748 |
| 4,499,606 | 2/1985 | Rambo | 455/277 |
| 4,506,267 | 3/1985 | Harmuth | 343/744 |

FOREIGN PATENT DOCUMENTS

| | | | |
|---|---|---|---|
| 889618 | 9/1953 | Fed. Rep. of Germany . | |
| 1131762 | 6/1962 | Fed. Rep. of Germany . | |
| 7015306 | 4/1970 | Fed. Rep. of Germany . | |
| 2425189 | 12/1974 | Fed. Rep. of Germany . | |
| 2514181 | 9/1975 | Fed. Rep. of Germany . | |
| 1949828 | 7/1976 | Fed. Rep. of Germany . | |
| 2745475 | 4/1979 | Fed. Rep. of Germany . | |
| 2733478 | 4/1980 | Fed. Rep. of Germany . | |
| 46617 | 8/1968 | Japan . | |
| 175221 | 5/1972 | Japan . | |
| 22418 | 7/1978 | Japan . | |
| 34826 | 8/1978 | Japan . | |
| 9195811 | 12/1984 | Japan . | |
| 60-1008 | 1/1985 | Japan . | |
| 60-1009 | 1/1985 | Japan . | |
| 60-1010 | 1/1985 | Japan . | |
| 60-1011 | 1/1985 | Japan . | |
| 60-1012 | 1/1985 | Japan . | |
| 60-172804 | 9/1985 | Japan | 343/713 |

OTHER PUBLICATIONS

Japanese Patent Abstrs., vol. 6, No. 55, E-101, Apr. 10, 1982, 56-168441.

Japanese Patent Abstrs., vol. 6, No. 37, E-97, Mar. 6, 1982, 56-156031.

Japanese Patent Abstrs., vol. 7, No. 162, E-187, Jul. 15, 1983, 58-070640.

(List continued on next page.)

*Primary Examiner*—William L. Sikes

*Assistant Examiner*—Robert E. Wise

*Attorney, Agent, or Firm*—Cushman, Darby & Cushman

[57] ABSTRACT

The present invention provides an automobile antenna system for detecting high-frequency surface currents induced on the vehicle body by external broadcast waves and supplying the detected signals to various built-in receivers. The automobile antenna system includes a high-frequency pick-up device positioned on the vehicle body at a pillar along the length thereof at which there is less noise and the density of the broadcast waves is increased.

4 Claims, 5 Drawing Sheets

OTHER PUBLICATIONS

Japanese Patent Abstrs., vol. 7, No. 162, E-187, Jul. 15, 1983, 58-070642.

Abstract of 55-88407, Antenna Device, 7/4/1980.

Abstract of 60-169204, On Vehicle Antenna System, 9/2/1985.

Abstract of 60-172804, Antenna System for Vehicle, 9/6/1985.

English Translation of German patent DE-OS 25 14 181.

English Translations of Japanese publications, 60-1008; 60-1009; 60-1010; 60-1011; 60-1012; 59-195811.

English Translation of German patent 1949828 (submitted earlier).

AUTOMOBILE ANTENNA

BACKGROUND OF THE INVENTION

1. Field of the Invention

The present invention relates to an automobile antenna and more particularly to an improved antenna system which can efficiently detect surface currents induced on the body of an automobile by received broadcast waves with detected signals being supplied to various built-in receivers mounted within the vehicle body.

2. Description of the Prior Art

Modern automobiles require antenna systems for causing built-in receivers to positively receive various TV and radio broadcast waves or communication waves for car-telephones. Such antenna systems also are very important for citizen-ban communications between automobiles and other movable or ground stations.

In the prior art, a pole type antenna was generally known which extends outwardly from the body of an automobile. Although the pole antenna exhibits a preferable performance on receiving broadcast and communication waves, it is always an obstruction from the standpoint of the design of the vehicle body.

Such a pole antenna tends to be carelessly or intentionally damaged or to be stolen. Furthermore, the pole antenna tends to produce an unpleasant noise when an automobile, on which the pole antenna is mounted, runs at high speeds.

Since the frequency bands of broadcast or communication waves have recently been increased, the automobile requires a plurality of antennas compatible with the number of the frequency bands. This further degrades the aesthetic appearance of the automobile. Furthermore, there results the problem that the reception performance is diminished by electrical interference between the antennas.

Some attempts have been made to eliminate or conceal the pole antennas. One of the attempts provides an antenna wire applied to the rear window glass of the vehicle body.

Another attempt is that surface currents induced on the vehicle body by broadcast waves are detected. It apparently appears that the utilization of such surface currents is most positive and efficient. However, experiments showed negative results.

One of the reasons why the surface currents induced on the vehicle body by the broadcast waves could not advantageously be utilized is that the level of the surface currents is not as large as expected. The prior art intended mainly to utilize surface currents induced on the roof panel of the vehicle body. Nevertheless, outputs could not the detected at sufficient levels.

The second reason is that a very large proportion of noise is present in the surface currents. The noise is primarily from the ignition and regulator systems of an engine and cannot be eliminated as long as the engine is running.

Some proposals have been made to overcome such problems. One of the proposals is disclosed in Japanese Patent Publication Sho No 53-22418 in which an electrical insulator is provided in a current concentrating portion on the vehicle body, with the level of current being detected by a sensor at the opposite ends of the insulator. Such an arrangement is effective to detect practicable signals which are supeior in SN ration.

However, for example, a cut-out must be formed in a portion of the vehicle body to accomodate a pick-up. This is not suitable for normal mass-production of automobiles.

Japanese Utility Model Publication Sho No 53-34826 shows another proposal which provides an antenna including a pick-up coil for detecting currents on a pillar of the vehicle body. Such an arrangement is advantageous in that the antenna can be concealed within the vehicle body. In fact, however, it is not practicable that the pick-up coil must be disposed adjacent to the pillar of the vehicle body in a direction perpendicular to the length of the pillar. Furthermore, such an arrangement does not provide a pick-up device which can obtain practicable outputs of the antenna. It appears that this proposal is only an idea.

SUMMARY OF THE INVENTION

It is therefore an object of the present invention to provide an improved antenna system suitable for use in small-sized automobiles, which surface currents induced on the vehicle body by broadcast waves can efficiently be detected and transmitted to built-in receivers.

To this end, the present invention is characterized by a high-frequency pick-up disposed along the length of a pillar on the vehicle body to detect surface currents having frequencies higher than a certain frequency.

The prior art antenna systems mainly intended to receive AM broadcast waves from the background of the times. As a result, good reception performance was not obtained since the wavelength of broadcast waves to be received by the prior art antenna systems was too long. The inventors aimed at this dependency of frequency and intend to receive broadcast waves having frequencies equal to or higher than FM frequency bands (normally, above 50 MHz). It is therefore possible to very efficiently receive signals from surface currents induced on the vehicle body.

The inventors further aimed at the fact that such high-frequency currents were distributed on the vehicle body at various different levels. Thus, the present invention is characterized by a high-frequency pick-up device disposed on the vehicle body at a location where there is less noise and higher density of the broadcast waves. In a preferred embodiment of the present invention, a pillar of the vehicle body is selected as such a location which can satisfy the above conditions.

The present invention is further characterized by the high-frequency pick-up device being disposed along the surface of the pillar to provide the positive detection of high-frequency currents having said characteristics of frequency. The pick-up device is of an electrode type which comprises a loop antenna for electromagnetically detecting a magnetic flux induced by currents on the vehicle body and which can form an electrostaic capacity between the loop antenna and the pillar to electrostatically detect high frequency signals. Thus, the detection can more efficiently be effected.

DESCRIPTION OF PREFERRED EMBODIMENTS

FIGS. 5–10 show a process of checking the distribution of high-frequency currents to determine a location on the vehicle body in which an antenna is positioned most efficiently.

Figure 5:
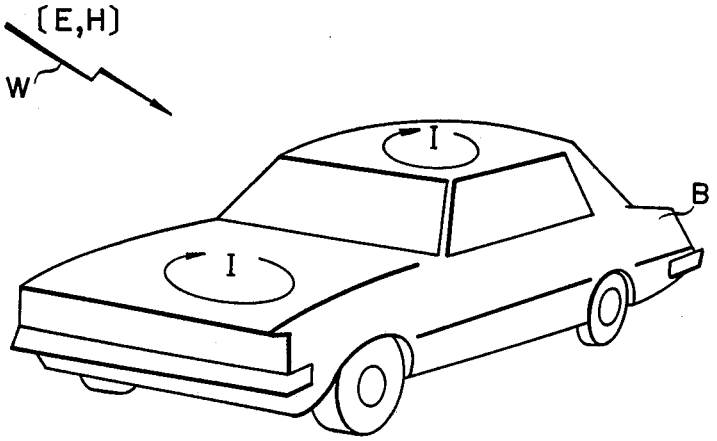
FIG. 5 illustrates surface currents I induced on the vehicle body B by external electromagnetic waves W.

FIG. 5 indicates the fact that when external elecromagnetic waves W such as broadcast waves pass through the vehicle body B of electrically conductive metal, surface currents I are induced on the vehicle body at various locations thereof, with the magnitude of the surface currents corresponding to the intensity of the electromagnetic waves. The present invention intends to utilize only frequency bands of these electromagnetic waves which belong to relatively high frequency bands or above 50 MHz, such as FM broadcast waves, TV broadcast waves and others.

The present invention is characterized by the fact that for the particular high-frequency bands, the distribution of induced currents is measured on the vehicle body to determine a location of higher current density and less noise at which a pick-up should be located.

The distribution of surface currents can be determined by using a simulation of a computer and by measuring actual intensities of surface currents at various locations on the vehicle body. In accordance with the present invention, a probe is used for this end which functions in accordance with the same principle as that of a high-frequency pick-up located at a desired location on the vehicle body as will be described. The probe is moved throughout the surface of the vehicle body while changing the orientation of the probe at each location. Thus, the measurement of surface currents can be carried out through the entire area of the vehicle body.

Figure 6:
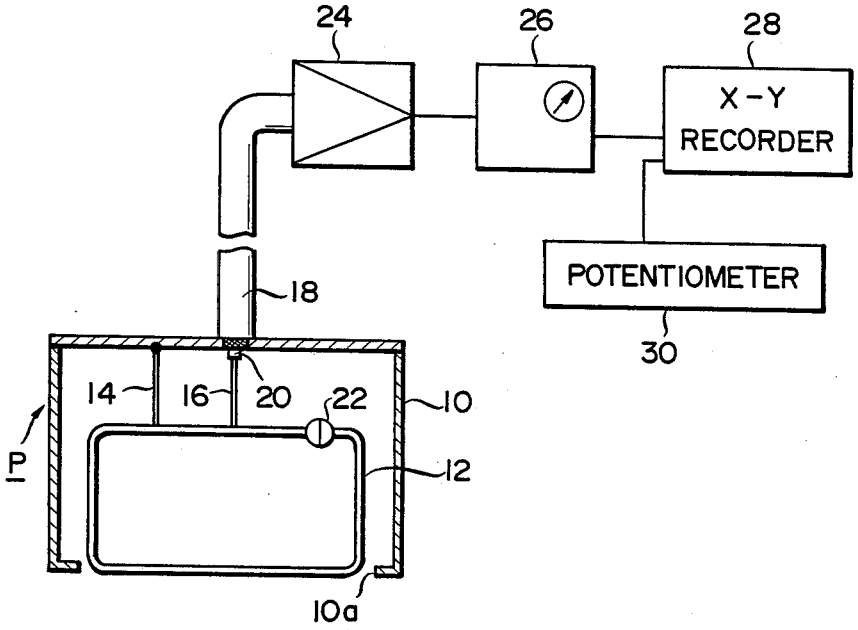
FIG. 6 illustrates a probe and its processing circuit for knowing the distribution of surface currents on the vehicle body, the probe having the same function as that of the high-frequency pick-up device used in the present invention.

FIG. 6 shows a probe P constructed in accordance with substantially the same principle as that of a high frequency pick-up device which will be described hereinafter. The probe P comprises a casing 10 of electrically conductive material and a loop coil 12 mounted within the casing. The casing 10 prevents any external electromagnetic wave from penetrating into the loop coil. The casing 10 includes an opening 10a formed therein through which part of the loop coil 12 extends outwardly. The exposed part of the loop coil 12 is located in close proximity to the surface of the vehicle body B to detect a magnetic flux induced by surface currents on the vehicle body. Another portion of the loop coil 12 is connected with the casing 10 through a short-circuiting line 14. The output 16 of the loop coil 12 is connected with conductor 20 in a coaxial cable 18. The loop coil 12 further includes a capacitor 22 for causing the frequency in the loop coil 12 to resonate with a desired frequency to be measured. This can increase the efficiency of the pick-up device.

The distribution and orientation of surface currents on the vehicle body B can accurately be determined by moving the probe P along the entire surface of the vehicle body B and also by angularly rotating the same probe at various locations of measurement.

Referring to FIG. 6, the output of the probe P is amplified by a high-frequency voltage amplifier 24 at which the output voltages of the probe are measured. The ouput voltages of the coil are read at a meter on the amplifier 26 and also recorded by an X - Y recorder 28 as indicative of a distribution of surface currents on the vehicle body. The input of the X - Y recorder 28 receives signals from a potentiometer 30 which are indicative of the respective locations on the vehicle body. In this manner, the high frequency surface currents at the respective locations on the vehicle body can be determined.

Figure 7:
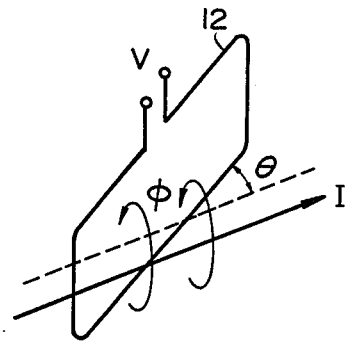
FIG. 7 illustrates the electromagnetic coupling state between the surface currents I and the pick-up loop antenna.
Figure 8:
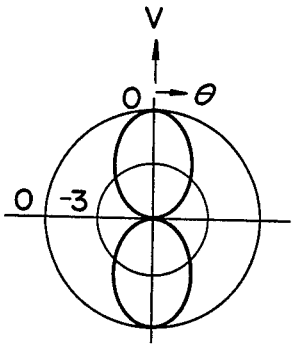
FIG. 8 illustrates the directional pattern of the loop antenna shown in FIG. 7.

FIG. 7 shows a deviation $\theta$ between high-frequency surface currents I and the loop antenna 12 of said pick-up. As seen from this figure, a magnetic flux $\phi$ induced by the currents I intersects the loop coil 12 to create a detection voltage V in the loop coil 12. When the deviation $\theta$ becomes zero, that is, the surface currents I becomes parallel to the loop coil 12 of the pick-up device as shown in FIG. 8, the maximum voltage can be obtained. At the respective locations on the vehicle body, therefore, the orientation of the surface currents I can be determined from the angular position of the rotated probe P at which the maximum voltage is detected.

Figure 9:
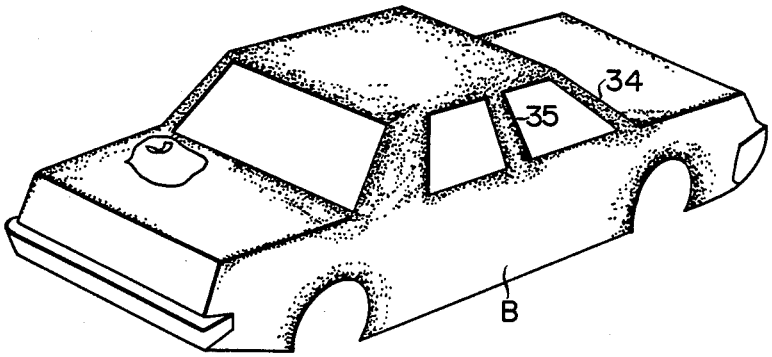
FIG. 9 illustrates the distribution of intensity of the surface currents.
Figure 10:
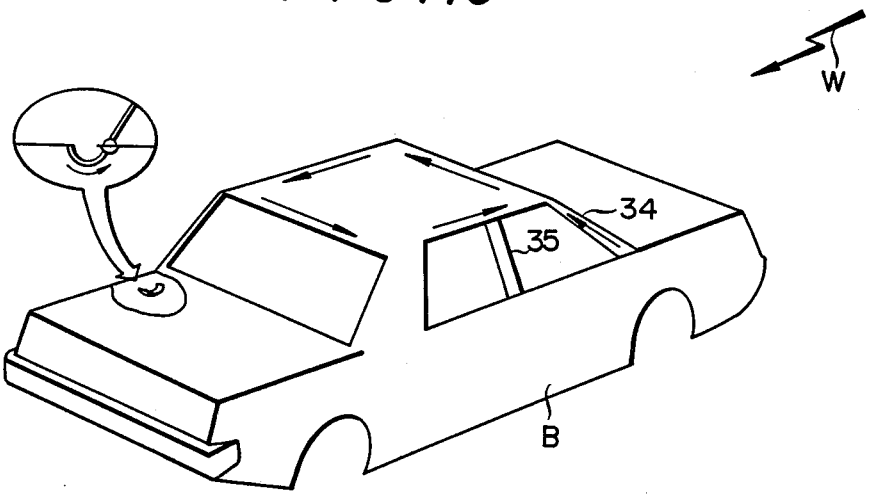
FIG. 10 illustrates the orientation of the surface currents.

FIGS. 9 and 10 show the magnitude and orientation of high-frequency surface currents induced on the vehicle body at various locations on the vehicle body by a broadcast wave having a frequency of 80 MHz, these results being determined from measurements obtained by the use of said probe P and also from a simulation of a computer. As will be apparent from FIG. 9, the density of the surface currents is increased at the marginal edges of the flat vehicle body portions while it is very reduced at the center of each of the flat vehicle body portions.

It is also understood from FIG. 10 that the surface currents concentrate on the vehicle body in a direction parallel to the marginal edges of the vehicle body or in a direction along the connections between the flat vehicle body portions.

It is to be noted that the surface currents concentrate on the vehicle body at the pillars supporting the roof of the vehicle body. The present invention is characterized by utilizing such pillars.

It is thus apparent that for FM frequency bands, the surface currents having densities equal to or higher than those of the other portions flow in the pillars. This tendency is increased as the level of the frequencies used is raised.

Figure 1:
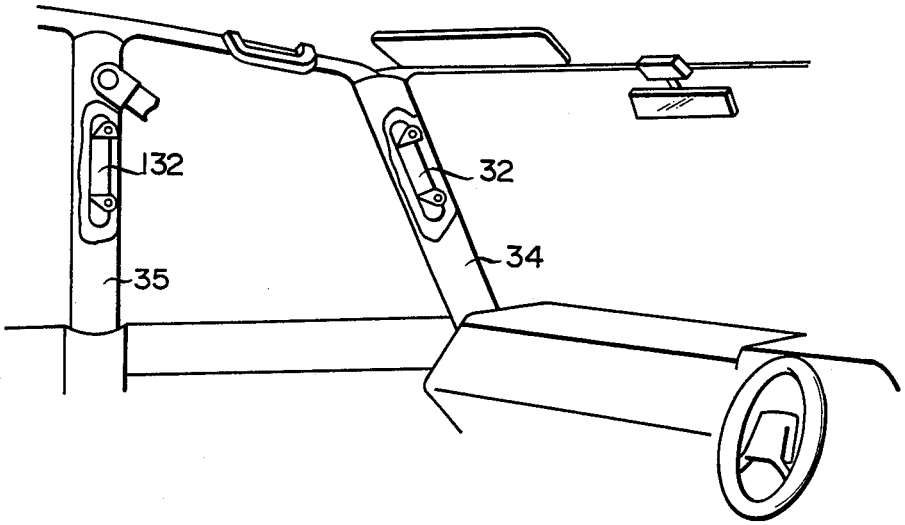
FIG. 1 is a schematic view illustrating front and center pillars in which a high-frequency pick-up device used in an automobile antenna system according to the present invention is to be mounted.

Referring now to FIG. 1, there is shown an antenna system of the present invention which comprises a high-frequency pick-up 32 or 132 mounted in either of the front or center pillar (34; 35) supporting the roof panel of the vehicle body. In the illustrated embodiment, the high-frequency pick-up device 32 or 132 is an electromagnetic coupling type, including a loop antenna.

The construction of the high-frequency pick-up 32 mounted in the front pillar 34 will now be described with respect to FIGS. 1–3.

Figure 2:
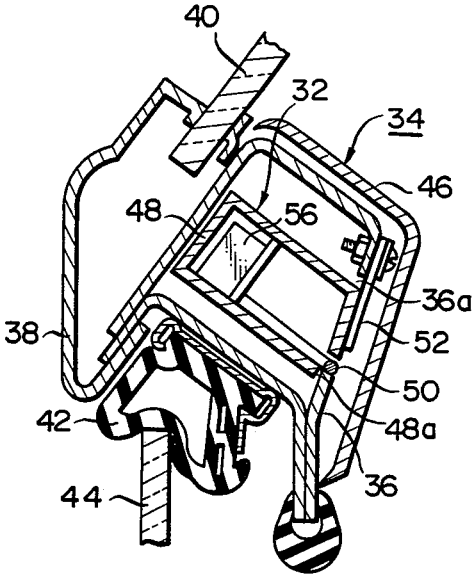
FIG. 2 is a cross-sectional view of the first embodiment of the present invention in which an electromagnetic coupling type high-frequency pick-up is mounted in the front pillar shown in FIG. 1.

As best seen from FIG. 2, the front pillar 34 includes a pillar leg plate 36 which is in the form of a hollow and quadrilateral column. The pillar leg plate 36 includes a wind-shield molding 38 fixedly mounted thereof at the outer wall thereof. The molding 38 supports a wind-shield glass 40.

The pillar leg plate 36 also includes a weather strip 42 of rubber fixedly attached thereto at the inner wall thereof. The weather strip 42 water-tightly seals between the pillar leg plate 36 and the side glass 44.

The pillar leg plate 36 further includes a front pillar garnish 46 mounted thereon at the side of the passenger room, which garnish 46 conceals the surface of the pillar leg plate 36 to povide a decorative appearance.

The feature of the present invention resides in the high-frequency pick-up disposed along the length of a pillar, that is, the front pillar 34 in the illustrated embodiment. The illustrated embodiment is characterized in that the electromagnetic coupling type high-frequency pick-up 32 is inserted into the hollow portion of said pillar leg plate 36.

Figure 3:
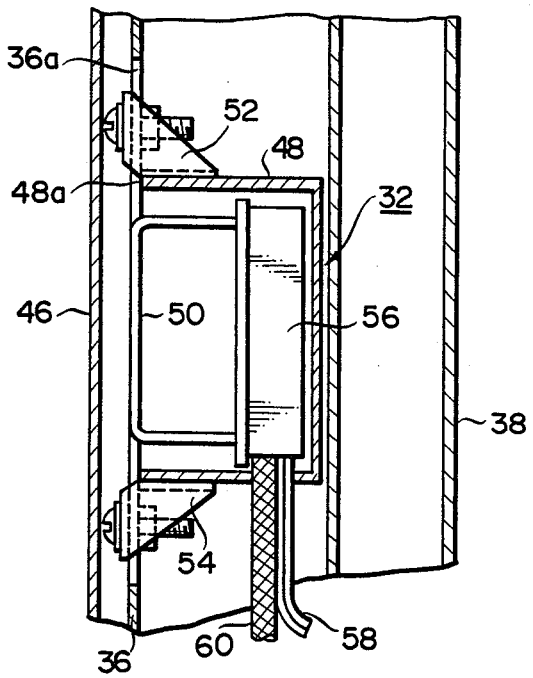
FIG. 3 is a longitudinal section of the primary part of the pick-up device shown in FIG. 2.

As seen from FIGS. 2 and 3, the high-frequency pick-up device 32 comprises a casing 48 of electronically conductive material and a loop antenna 50 mounted within the casing 48. The casing 48 serves as means for shielding electromagnetic fields from the external. The casing 48 includes an opening 48*a* formed therein at one side. The loop antenna 50 extends outwardly through the opening 48*a* of the casing 48 and is located in close proximity to a pillar on which high-frequency surface currents concentrate, and particularly the pillar leg plate 36.

The pillar leg plate 36 is provided with an opening 36a through which the high-frequency pick-up 32 is inserted into the hollow portion thereof. The high-frequency pick-up 32 is inserted into the hollow portion of the pillar leg plate 36 before the front pillar garnish 46 is mounted on the pillar leg plate 36.

To fasten the casing 48 of the high-frequency pick-up 32 on the pillar leg plate 36, the casing 48 includes brackets 52 and 54 fixedly attached thereto at the opposite ends as by spot-welding. These brackets 52 and 54 are firmly fastened on the pillar leg plate 36 by any suitable screw means.

When the casing 48 of the pick-up 32 is fixedly mounted on the pillar leg plate 36, the loop antenna 50 is positioned in close proximity to the opening 36a of the pillar leg plate 36 such that a magnetic flux induced by high-frequency surface currents concentrically flowing in the pillar leg plate 36 will efficiently intersect the loop antenna 50.

Within said casing 48, a circuit section 56 including a pre-amplifier and others is mounted behind the loop antenna 50. The circuit section 56 includes a source of power and a circuit similar to the circuit used in determining the distribution of surface currents. The circuit receives signals through a cable 58. High-frequency signals detected by the loop antenna 50 are fetched out of the circuit through a coaxial cable 60.

In the illustrated embodiment, the loop antenna 50 is preferably a single-winding antenna of such construction that the coil is coated with any suitable insulation material and pressed against the marginal edge of the pillar leg plate so that the loop antenna 50 will be in contact with the pillar leg plate 36 while at the same time the loop antenna 50 can be electrically insulated from the pillar leg plate 36. As a result, the magnetic flux induced by the high-frequency surface currents concentrically flowing in the pillar can intersect the loop antenna 50 efficiently.

After the high-frequency pick-up 32 is mounted in the front pillar 34, the front pillar garnish 46 is mounted on the pillar 34 to provide the same appearance as that of the conventional pillar construction.

In the first embodiment of the present invention, therefore, the high-frequency surface currents concentrically flowing in the front pillar of the vehicle body can effectively be detected by the loop antenna disposed within the pillar prependicular to the length thereof without external exposure of the antenna.

Figure 4:
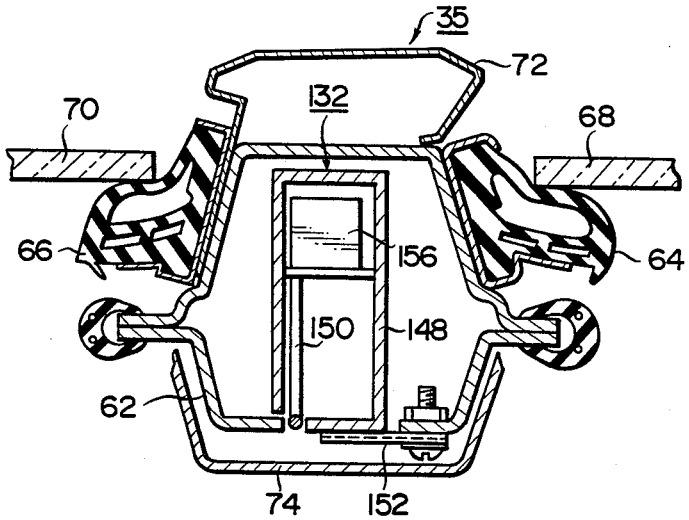
FIG. 4 is a cross-sectional view of the second embodiment of the present invention in which an electromagnetic coupling type pick-up device according to the present invention is mounted in the center pillar shown in FIG. 1.

FIG. 4 shows the second embodiment of the present invention in which a high-frequency pick-up device 132 is mounted in the center pillar 35 shown in FIG. 1.

The center pillar 35 comprises a pillar leg plate 62 which is in the form of a hollow and quadrilateral column as in the front pillar 34. Weather strips 64 and 66 are fixedly mounted on the opposite sides of the pillar leg plate 62 to provide water-tight sealing means between the pillar leg plate 62 and a front or rear side glass (68 ; 70). The outer wall of the pillar leg plate 62 fixedly supports a front pillar garnish 72 while the inner wall of the same is covered with a center pillar ganish 74.

The high-frequency pick-up device 132 is an electromagnetic coupling type pick-up having a construction substantially similar to that of the first embodiment of the present invention. The pick-up device 132 comprises a casing 148 of electrically conductive material, a loop antenna 150 housed in the casing 148 and a circuit section 156 similarly mounted within thte casing 148. The casing 148 also includes brackets 152 (only one shown) spot-welded thereto which are fastened to the edge of an opening formed in the pillar leg plate 62 by any suitable screw means.

In the second embodiment of the present invention, the high-frequency pick-up device 132 is similarly inserted into and fastened to the interior of the pillar column 62 through the opening thereof. The loop antenna 150 is disposed in close proximity to the shortened edge of the pillar leg plate 62.

In the second embodiment, thus, the high-frequency surface currents concentrically flowing in the center pillar can positively be caught by the loop antenna through high-frequency bands higher than 50 MHz and yet the antenna will not be exposed externally, as in first embodiment.

Although the present invention has been described as to the electromagnetic coupling type pick-up device, the high-frequency pick-up device used in the present invention may be of an electrostatic coupling type as long as it can detect surface currents induced on the vehicle body at the pillars by external broadcast waves.

In the case of the electrostatic coupling type pick-up, a detecting electrode means is arranged along the length of a pillar and spaced away from the pillar through an air gap or insulating plate which forms an elecrostatic capacity. High-frequency surface currents can be fetched by the detecting electrode means through the electrostatic capacity to detect high-frequency signals in a desired frequency band.

It will be apparent from the foregoing that the present invention provides a broadcast wave receiving antenna system which can detect high-frequency surface currents induced on the vehicle body at a specified location and particularly at a pillar by relatively high frequency bands such as broadcast waves beyond FM frequency bands. Thus, the broadcast waves can well be detected with higher density and less noise without external exposure of the antenna.

We claim:

1. An antenna system disposed within a hollow pillar of an automobile body, the hollow pillar having an opening, said antenna system being provided for picking up high frequency signals, said antenna system comprising:

loop antenna means provided for electromagnetically detecting a magnetic flux formed by high-frequency surface currents flowing concentratedly in an edge surface of the opening in the hollow pillar;

a casing made of electrically conductive material for shielding an external electromagnetic field and for encasing said loop antenna means, said casing including an opening formed in one side through which only one side of said loop antenna means is externally exposed, said casing being disposed within the hollow pillar in which the high-frequency surface currents flow, said casing and said loop antenna means comprising a high-frequency pick-up means; and mounting means for mounting said casing, encasing said loop antenna means, within the hollow pillar such that said one side of said loop antenna means and the opening in said casing extends along the length of the hollow pillar opposite to and in close proximity to the edge surface of the opening in the hollow pillar.

2. An antenna system as in claim 1 said high-frequency pick-up means being provided for receiving broadcast waves belonging to frequency bands equal to or higher than 50 MHz.

3. An antenna system as in claim 1 wherein said high-frequency pick-up means is inserted into and attached to the interior of the pillar through an opening formed in a pillar leg plate, said loop antenna means being positioned in close proximity to the pillar leg plate.

4. An antenna system as in claim 1 said mounting means including:

a pair of brackets for clamping said high-frequency pickup means at two sides thereof, each of said brackets having one end thereof rigidly fasted to a marginal edge portion of the automobile body; and an automobile body connecting piece which is connected to the automobile body and to which said pair of brackets clamping said high-frequency pickup means therebetween are secured, such that said loop antenna means of said high-frequency pickup means opposes the marginal edge portion of the automobile body.

* * * * *